US011933129B2

(12) United States Patent
Rakhunde et al.

(10) Patent No.: US 11,933,129 B2
(45) Date of Patent: Mar. 19, 2024

(54) ELECTRICAL DRILLING AND PRODUCTION SYSTEMS AND METHODS

(71) Applicant: Schlumberger Technology Corporation, Sugar Land, TX (US)

(72) Inventors: Vikas Rakhunde, Cypress, TX (US); Nathan Cooper, Cypress, TX (US); Justin Blair, Houston, TX (US); Michael W. Berckenhoff, Spring, TX (US); Michael Mancuso, Pavia (IT); Matthew Givens, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/340,639

(22) Filed: Jun. 23, 2023

(65) Prior Publication Data

US 2023/0332477 A1 Oct. 19, 2023

Related U.S. Application Data

(63) Continuation of application No. 16/313,460, filed as application No. PCT/US2017/041367 on Jul. 10, 2017, now Pat. No. 11,739,605.

(Continued)

(51) Int. Cl.
*E21B 33/035* (2006.01)
*E21B 34/04* (2006.01)

(52) U.S. Cl.
CPC ..... *E21B 33/0355* (2013.01); *E21B 34/04* (2013.01)

(58) Field of Classification Search
CPC ..... E21B 33/0355; E21B 34/04

(Continued)

(56) References Cited

U.S. PATENT DOCUMENTS 3,319,923 A * 5/1967 Haeber ..... E21B 33/064 251/1.3
5,070,904 A * 12/1991 McMahon, Jr. ..... E21B 33/064 137/1

(Continued)

FOREIGN PATENT DOCUMENTS

EP 3039226 B1 2/2019

OTHER PUBLICATIONS

International Search Report and Written Opinion issued in International Patent application PCT/US2017/041367 dated Sep. 22, 2017.

(Continued)

*Primary Examiner* — Matthew R Buck
*Assistant Examiner* — Patrick F Lambe
(74) *Attorney, Agent, or Firm* — Jeffrey D. Frantz

(57) ABSTRACT

A drilling and production system is provided. In one embodiment, such a system has a plurality of functions that are effectuated at least predominately without hydraulic fluid. The system can be a drilling system having a rig and a subsea stack for performing various drilling functions, in which a majority of the drilling functions are effected electrically without hydraulic control fluid. In another embodiment, the rig is coupled to a subsea wellhead assembly but is not connected so as to provide hydraulic control fluid from the rig to the subsea wellhead assembly to enable drilling functions of the subsea wellhead assembly. Additional systems, devices, and methods are also disclosed.

20 Claims, 16 Drawing Sheets

Related U.S. Application Data

(60) Provisional application No. 62/360,404, filed on Jul. 10, 2016.

(58) Field of Classification Search
USPC ..... 166/344
See application file for complete search history.

(56) References Cited

U.S. PATENT DOCUMENTS

| | | | | |
|---|---|---|---|---|
| 5,547,029 | A * | 8/1996 | Rubbo | E21B 43/14 166/65.1 |
| 8,789,606 | B1 | 7/2014 | Lugo | |
| 2004/0031940 | A1* | 2/2004 | Biester | E21B 33/062 251/1.3 |
| 2007/0107907 | A1* | 5/2007 | Smedstad | E21B 43/128 166/357 |
| 2008/0110633 | A1 | 5/2008 | Trewhella | |
| 2009/0194290 | A1 | 8/2009 | Parks | |
| 2014/0102712 | A1 | 4/2014 | Gutierrez | |
| 2014/0102713 | A1* | 4/2014 | Gutierrez | E21B 41/0007 166/363 |
| 2015/0211504 | A1* | 7/2015 | Dieringer | F04B 17/03 417/415 |
| 2015/0240585 | A1 | 8/2015 | Mancuso | |
| 2016/0177700 | A1 | 6/2016 | Scott | |

OTHER PUBLICATIONS

International Preliminary Report on Patentability issued in International Patent application PCT/US2017/041367, dated Jan. 24, 2019.

Jernstrom, Sangesland, Hagglin; "An All-electric System for Subsea Well Control", 1993, Offshore Technology Conference, OTC 7335, pp. 705-711 (Year: 1993).

* cited by examiner

ELECTRICAL DRILLING AND PRODUCTION SYSTEMS AND METHODS

CROSS REFERENCE PARAGRAPH

This application is a continuation of U.S. patent application Ser. No. 16/313,460, filed Dec. 26, 2018, which is a National Stage Entry of PCT/US2017/041367, filed Jul. 10, 2017, which claims the benefit and priority of U.S. Provisional Application No. 62/360,404, filed Jul. 10, 2016. Each of the above applications is hereby expressly incorporated by reference in its entirety as if fully set forth below and for all applicable purposes.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

To meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly through which the resource is accessed or extracted. These wellhead assemblies may include a wide variety of components, such as various casings, valves, fluid conduits, and the like, that control drilling or extraction operations, with such components arranged in a stack or subsea production tree configuration, for example.

Wellhead assemblies typically include control pods that, as the name suggests, control and manage the delivery of control fluid to various components. For example, the control pods may direct control fluid to and from blowout preventers, actuators and valves via tubing coupled to a control-fluid source. When a particular hydraulic function is to be performed (e.g., closing a ram of a blowout preventer), a control pod valve associated with that function opens to supply control fluid to the component responsible for carrying out the hydraulic function (e.g., a piston of the blowout preventer). To provide redundancy in subsea applications, American Petroleum Institute Specification 16D (API Spec 16D) requires a subsea wellhead assembly include two subsea control pods—designated as a "yellow" pod and a "blue" pod—for controlling the assembly's hydraulically operated components.

For over forty years, the industry has relied on control fluid as the primary mechanism for actuating various drilling components—like a BOP—for both onshore and offshore operations. As a result, most wellhead assemblies have banks of accumulators storing pressurized control fluid, which often adds to the weight of the BOP system and, potentially, the supporting rig or vessel. Control-fluid accumulators can also be difficult to recharge in an efficient manner. And it is difficult to monitor the operational status of the control fluid in the accumulators, as well as the control fluid in the system as a whole.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to electrically operated drilling and production systems and components. In one embodiment, most if not all of the previously hydraulically operated components within the drilling system are replaced with electrically driven and controlled ones. For example, in one embodiment, the accumulator banks are replaced with devices that supply and/or store electrical current, such as batteries or a flywheel generator. The supplied current then feeds into various electrically operated components, like electrical motors and actuators. As another example, the hydraulic control pods may be replaced with electrical communications and distribution equipment.

Removing hydraulically operated components from a drilling or production system-whether it is land based or subsea-provides a number of advantages, including improved operational control, reduced rig and equipment weight, and improved data collection, to name but a few.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
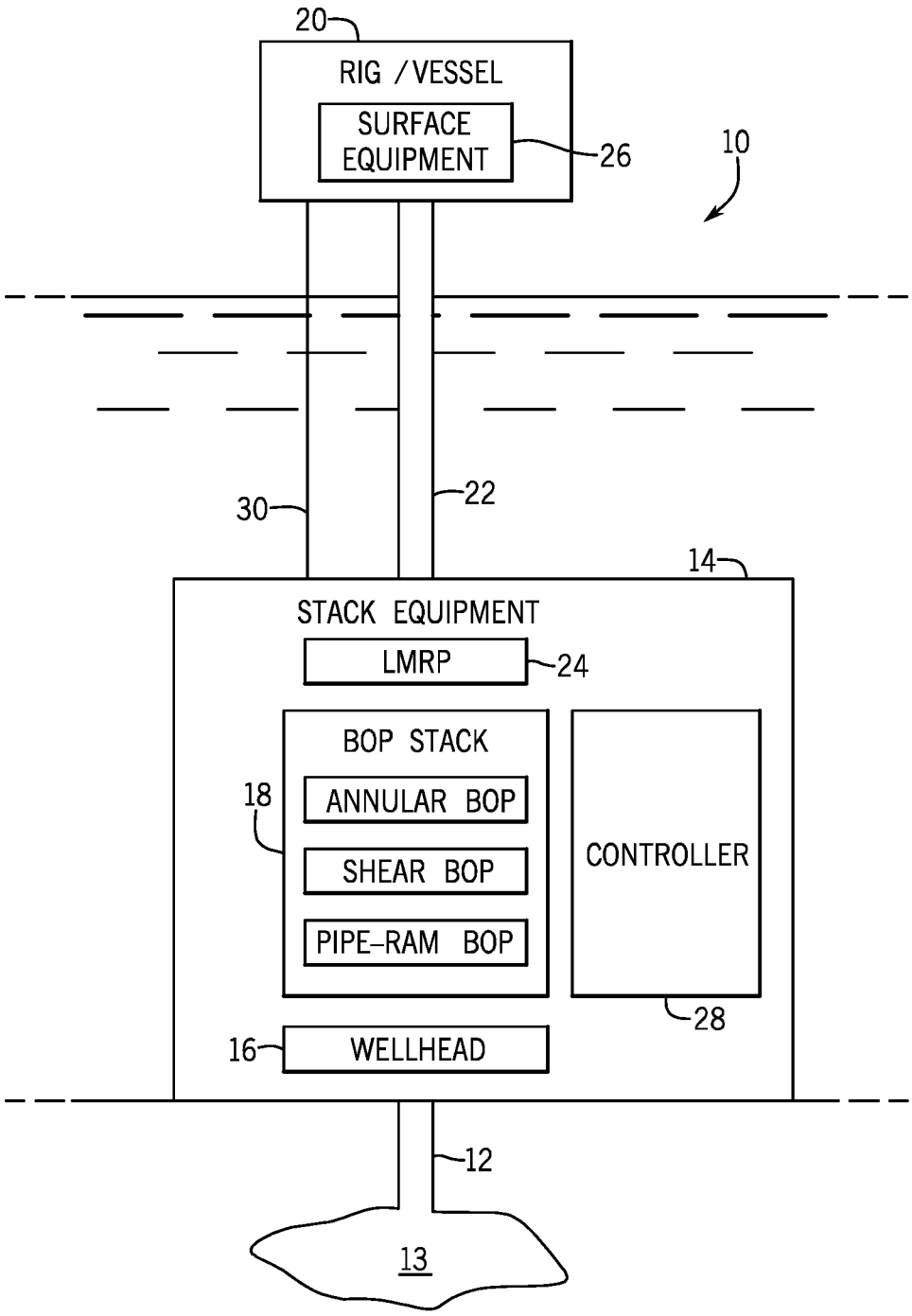
FIG. 1 schematically depicts a subsea drilling system for accessing or extracting a resource, such as oil or natural gas, via a well, in accordance with an embodiment of the present disclosure.

Turning now the figures, FIG. 1 illustrates a system 10 in accordance with one embodiment. Notably, the system 10 (e.g., a drilling system or a production system) facilitates access to or extraction of a resource, such as oil or natural gas, from a well 12. As depicted, the system 10 is a subsea drilling system designed for accessing hydrocarbons from a reservoir formation 13 beneath the sea floor. But the concepts disclosed herein can be applied to both onshore and offshore drilling, as well as to post-drilling production operations employing production equipment like surface or subsea trees.

Subsea drilling and production operations are quite complex, requiring a myriad of equipment. Fluid flow into and out of the well 12 is managed by stack equipment 14 connected to the sea floor. As shown, the stack equipment 14 (which may also be referred to as a subsea wellhead assembly) includes a wellhead 16 that's mounted to the sea floor and that provides an interface point to the well 12. The wellhead 16 also provides a support structure onto which other stack equipment, like a BOP stack 18, can be mounted.

The primary function of the BOP (blowout preventer) stack 18 is to assist controlling the ingress and egress of wellbore fluid (e.g., drilling mud, formation fluids, hydrocarbons, inhibitors) with respect to the well. There are numerous types of BOPs that can be assembled into the stack, but some of the most common are annular BOPs and ram BOPs. Annular BOPs typically have a large rubber "doughnut" that is compressed to seal around a drillpipe that is extending into the well 12 through the BOP, while ram BOPs have horizontally opposed rams that are actuated toward one another to seal the well. These rams may be shear rams designed to cut through drillpipe before sealing off the well; the rams may be pipe rams designed to seal against the outer surface of the drillpipe; or the rams may be blind rams designed to seal against one another when there is no drillpipe or other component extending through the BOP, for example.

In a subsea drilling system, as is shown, the stack equipment 14 is connected to a rig 20 or vessel located at the sea's surface via a riser string 22. In short, the riser string 22 creates an artificial "bore" that allows wellbore fluid to be conveyed between the rig 20 at the sea's surface and the stack equipment 14 located at the sea floor. The riser string 22 typically comprises multiple segments of riser pipe that are coupled to one another until the desired length of riser string 22 is achieved. To facilitate the riser string's connection, the stack equipment 14 may include an LMRP (lower marine riser package). As an example, the LMRP 24 may include a flex joint connection that accommodates the upper end of the riser which may be coupled to a floating vessel-moving with respect to the lower end of the riser mounted to the stack equipment fixed to the sea floor. Moreover, in an emergency situation, the LMRP can be activated to release the riser string, allowing the rig to move away from the stack equipment and well.

Control and operation of the stack equipment 14 can be facilitated by surface equipment 26 located on the rig 20. For example, the surface equipment 26 may include a human-machine interface (HMI) that allows the operator to input various commands that are communicated to a controller 28, which may be located on the subsea stack 14, via a cabling system 30. The surface equipment 26 may also include a variety of devices and systems, such as pumps, power supplies, cable and hose reels, control units, a diverter, a gimbal, a spider, and the like. Certain surface equipment, and their control relationship with the subsea stack equipment, are discussed in further detail below.

The exemplary system 10 may be an all-, substantially or predominately electric system, in which many of the hydraulically operated components traditionally found on drilling and production systems have been replaced or removed. Advantageously, replacing the hydraulically operated components with electrically controlled ones provides a number of benefits, including improved control, weight reduction, and better data collection, to name a few.

FIGS. 2A-2D illustrate schematically the topology of certain power and communications focused equipment for an exemplary all- or predominately electric drilling system. As shown, the surface equipment 26 is connected to the subsea stack equipment 14 via a data network 32 and a power network 34. In the illustrated embodiment, data and power are communicated over a combined data and power network 32, 34. That is, data is communicated over the same conductors that communicate power, for instance. However, it is also envisaged that the data and power are communicated over separate networks, or that portions of the power and data network are independent and other portions are not.

The nerve center of the exemplary networks is the command architecture 36, certain components of which may be located on the rig 20 in a driller's cabin or disbursed throughout the drilling system. The command architecture 36 may include processing equipment, like a processor or programmable logic circuitry, that receives inputs from various locations and provides commands based on programming. Or, for manual operation, a human-machine interface (HMI) 38 facilitates the rig's operator providing commands to and receiving data regarding the drilling system. And the rig's operator need not be resident on the rig. Command inputs and operating data may also be communicated via a wireless communications system 40 connected to the data network 32, facilitating real-time monitoring and remote operation of the drilling system 10. Moreover, the command architecture may include one or more data ports 41—similar to an OBD-II port on automobiles, for instance—to facilitate communications with and control via a portable device.

Management of the exemplary drilling system's communication is conducted by a communication and distribution panel 42, which may operate using well-known protocols like TCP/IP or Ethernet/IP, or a proprietary protocol, among others.

Figure 2A:
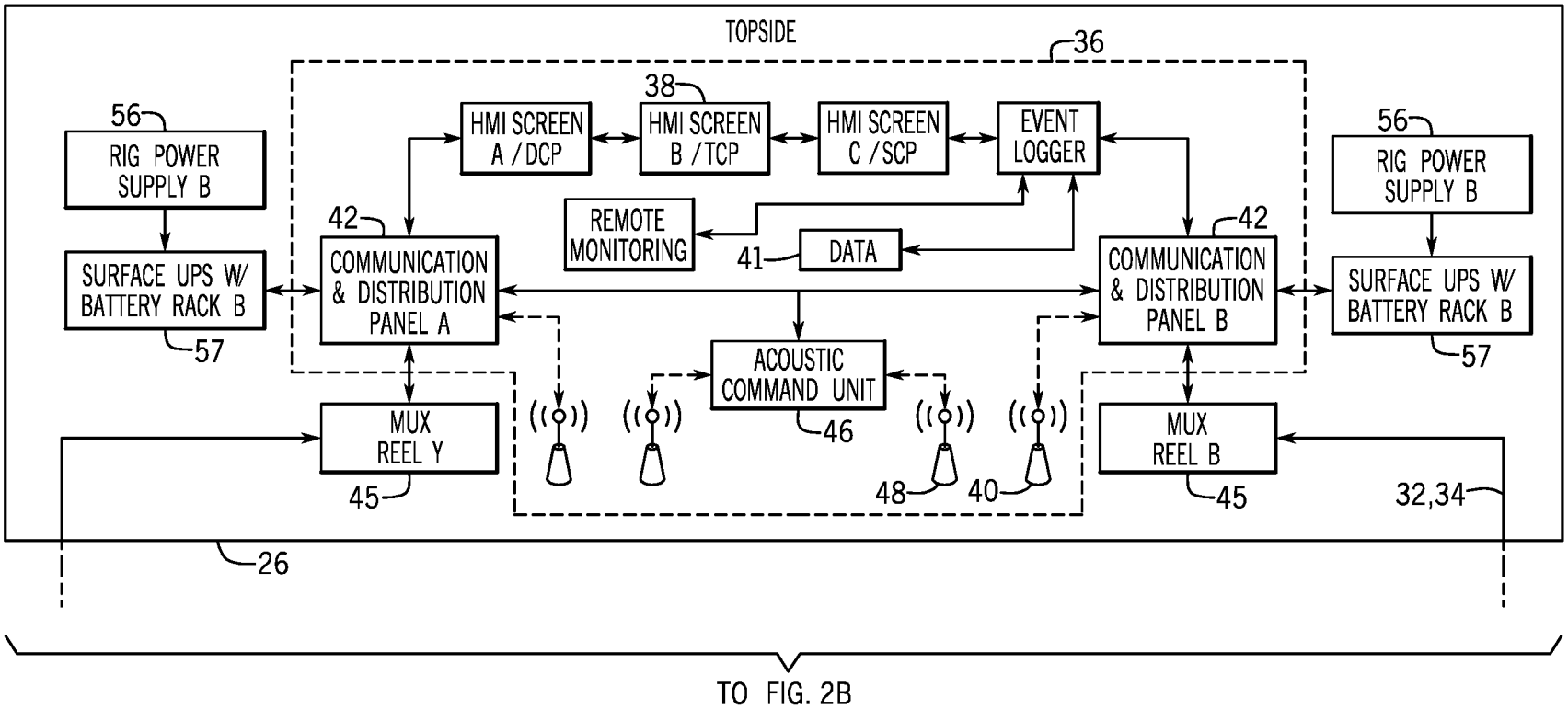
FIGS. 2A-2D illustrate schematically the electrical power and communications topology of a subsea drilling system, in accordance with an embodiment of the present disclosure.
Figure 2B:
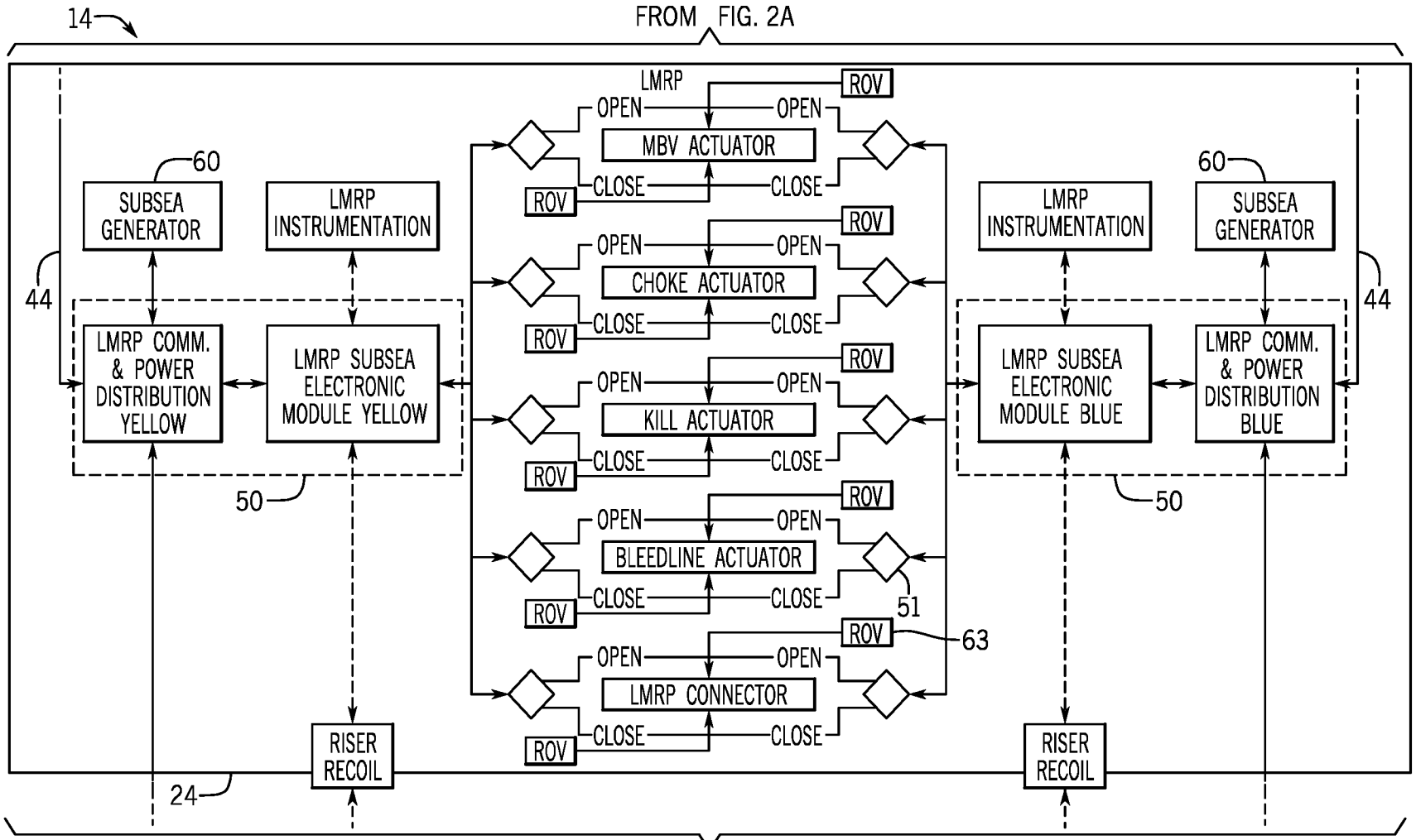
Figure 2C:
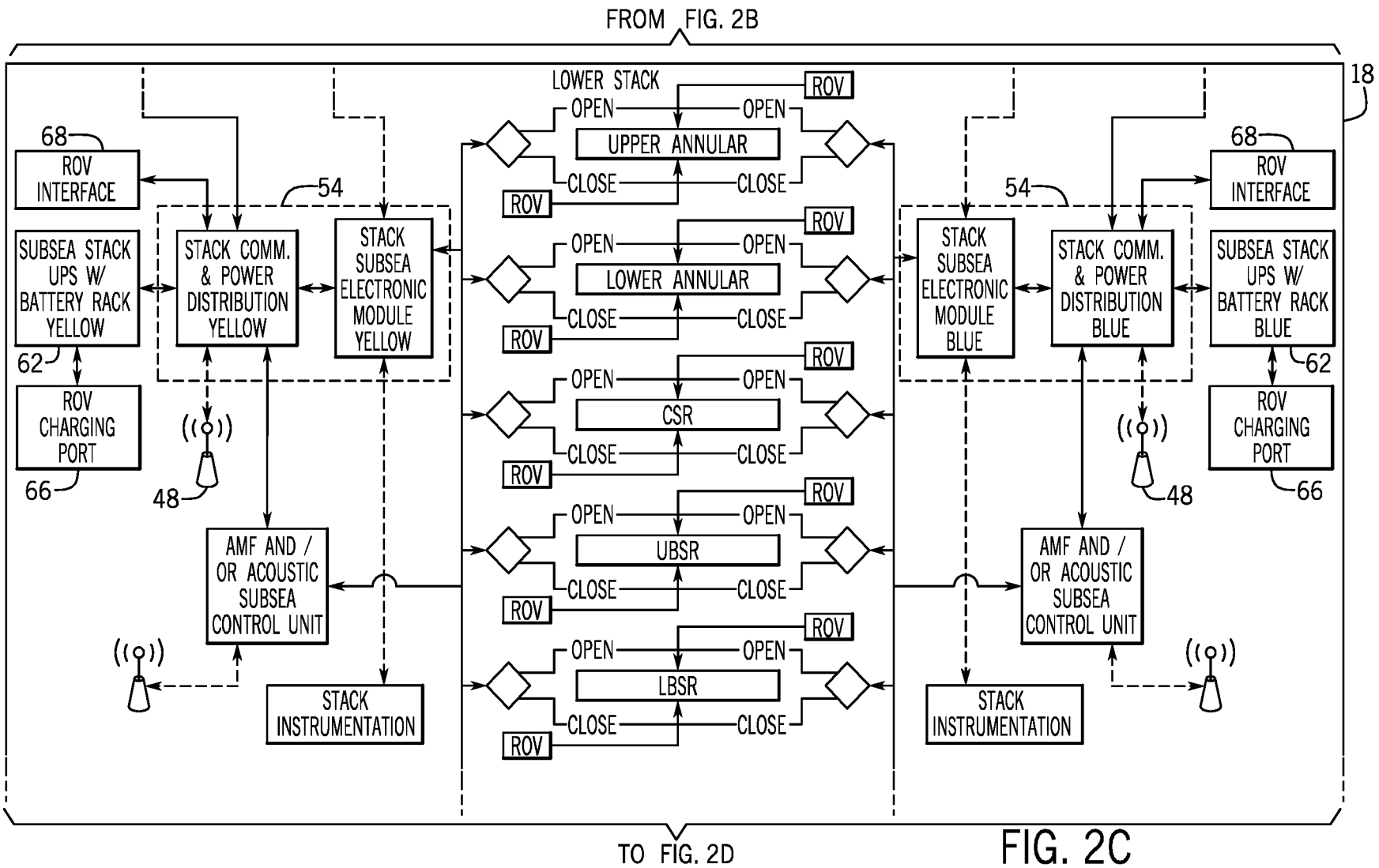
Figure 2D:
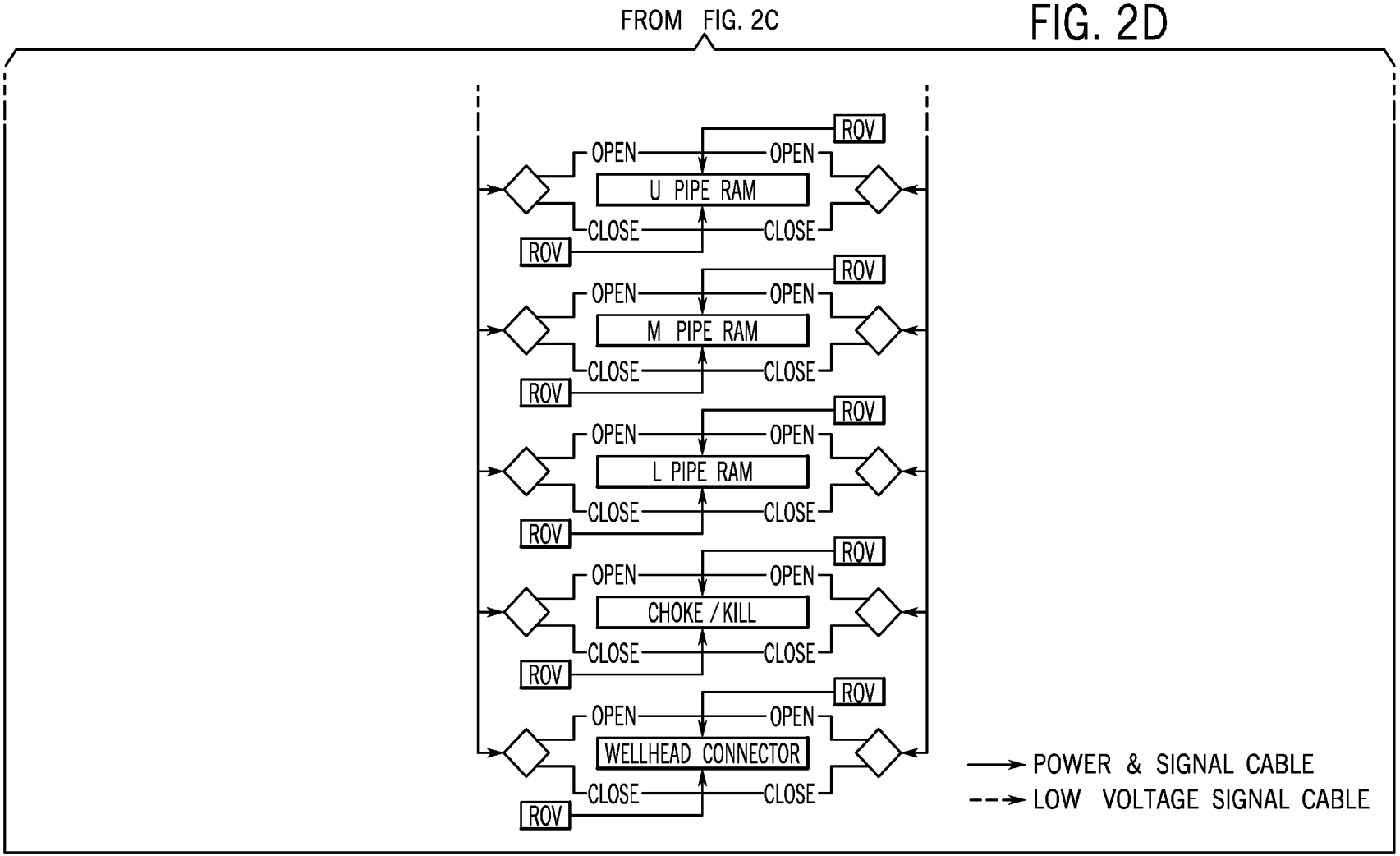

In the illustrated drilling system 10, the data network 32 employs two general methodologies for communications between the surface equipment 26 and the subsea stack equipment 14. The first is a cabled connection, in which a cable 44 extends from the rig down to the subsea stack equipment 14. Any number of cable types may be employed, including fiber optic cables, cables designed to carry both data and power, MUX cables, or bundled cables, to name but a few. As shown in FIGS. 2A and 2B, the drilling system 10 has a MUX cable 44 that is stored in a reel 45 on the rig 20 and that extends from the rig 20 to the subsea stack equipment 14. The MUX cable may comprise a bundle of various types of cable, in which power and data are sent over a single conductor or in which power and data are sent over different conductors. For example, the power may be transmitted over a lower gauge copper wire, while data is transmitted over a fiber optic cable or higher gauge wire.

These cabled connections can include more than just simple cables. For example, the cable connection may include magnetic elements—like rare earth magnets—that enable the cable to mechanically connect to the riser system 22. Moreover, the cable connection may be incorporated into the riser itself. That is, some or all of the riser segments in the riser string 22 may include integrated cable segments that couple to one another through a wet mate connector, or connectors that inductively communicate data, or a combination of the two. In another embodiment, the cables may be secured to the risers by clamps that close to secure the cable with respect to the riser string.

The second general communication methodology employs acoustics. In the exemplary system 10, the command architecture 36 includes an acoustic command unit 46 coupled to a transducer 48. Using the seawater as a medium, the transducer 48 transmits and receives acoustic signals sent to and from a transducer on the subsea equipment stack 14, on a remote operated vehicle (ROV), or on an autonomous underwater vehicle (AUV). But these two methodologies are just examples. It is also envisaged that the rig 20 may communicate with the subsea stack, or other components or devices located subsea, via radio waves employing very-low frequency (VLF) and super-low frequency (SLF) signals, for instance.

Communications between the rig 20 and the subsea stack 14 in the illustrated drilling system are transmitted by or to one or more controllers 28 located on the subsea stack 14. For example, the illustrated drilling system includes an LMRP electronics control module 50, which manages the communications and power distributions to various components on the LMRP 24. Put differently, this control module 50 controls the activation and deactivation of various "functions" on the LMRP, functions that are traditional hydraulically controlled using control fluid. The illustrated LMRP control module 50 manages five functions—namely the operation of five actuators on the LMRP—but the module can be sized to control more or fewer functions, if desired. As discussed in further detail below, a command signal may be sent to the LMRP control module 50, causing the module 50 to provide another command signal to switching circuitry, like a relay 51 or a solid state switching circuit, that directs operating power to the given actuator, effecting the desired function. That is, appropriately conditioned power—whether AC or DC—is routed to an electric motor to effect a function, like opening or closing a choke or activating or releasing a connector, through actuation. Advantageously, data collected from sensors on the drilling system, including sensors on the LMRP and the BOPs, can communicate operational data back to the rig 20 via the given controller 28, like the module 50.

The illustrated BOP stack 18 is operated in a similar manner, employing a BOP control module 54 that controls the activation and deactivation of various "functions" on the BOP stack, again functions that are traditional hydraulically controlled using control fluid. As shown, the BOP control module 54 controls ten functions on that BOP stack, such as the opening and closing of various valves, rams, annulars, and connectors (which are examples of pressure control equipment) on the BOP stack 18. Indeed, the subsea stack 14 includes an LMRP connector and a BOP wellhead connector that are energized and released via an electrically driven actuator having linear or push motor to drive collet connectors, for example. While five functions are depicted as controlled by the LMRP control module 50 and ten functions are depicted as controlled by the BOP control module 54 in the present illustration as examples, it will be appreciated that these control modules 50 and 54 can control other functions (e.g., pressure control functions) in addition to, or instead of, those presently depicted. Although depicted together in FIG. 2D with a single actuator for simplicity, the choke and kill functions may be performed with separate actuators and considered separate functions. In some embodiments, predominately all of the functions (i.e., a majority of the functions) of the stack equipment 14 are effected electrically without hydraulic control fluid. And in some of these embodiments, substantially all of the functions (i.e., at least eight-five percent of the functions) of the stack equipment 14 are effected electrically without hydraulic control fluid. Still further, either or both of the BOP stack 18 and the LMRP 24 can be configured to perform each of its drilling functions without hydraulic control fluid.

The BOP control module 54 may be in communication with the LMRP control module 50, or it may be in direct communication with the rig 20 via direct cabling. Moreover, each of the control modules 50, 54 may include its own acoustic system 46 with a transducer 48, for acoustic communications with the rig 20.

Moreover, these control systems 50, 54 may be in communication with and provide power to equipment related to the riser system 22. For example, these systems 50, 54 may manage and control a riser recoil system that mitigates unwanted movement of the riser during disconnect operations.

Advantageously, in an all- or predominantly electric drilling system, much of the hydraulic cabling, the accumulator banks feeding the cables, and the associated supporting equipment (e.g., reels, hydraulic power units, rig plumbing, fluid mixes, umbilicals) can be removed from the rig 20, reducing the rig's complexity and weight. Moreover, in a hydraulic system, adding additional functions to the control pod requires significant redesign and a significant increase in the hydraulic control fluid needed for operation, whereas adding further functions to electrical systems is significantly easier.

If the command architecture 36 and data network 32 are the nervous system, then the power network 34 is the drilling system's circulatory track. To provide electrical power, the rig 20 includes a power supply 56, which may be any one of a number of devices that generate electrical current. For example, the power supply may be a solar array, a hydrogen fuel cell, a generator that converts diesel, gasoline or natural gas into electric current, a turbine electric generator, or a wave energy generator that converts the kinetic energy of the sea into electrical current; and these power generation systems may output three-phase AC, single-phase AC, or DC power, for example, depending on the needs of the drilling system. Indeed, the drilling system may include conditioning circuitry to condition the generated current (e.g., rectify, invert, pulse-width modulate, reduce voltage) so as to be appropriate for the given components.

On the rig 20, the power supply 56 is connected to a back-up or uninterruptable power supply 57, which may have a number of configurations. For example, the back-up may be a battery rack or capacitor bank that's trickle charged by the power supply, electricity generated through movement of a piezo-electric element, solar panels during quiescent operations, or via the power generation devices discussed above. Alternatively, the back-up may be a fly-wheel based system that converts the mechanical rotation of a fly wheel-motion effected by the primary supply, for example, during normal operation-into electrical energy when the primary supply is lost. Upon a loss of primary power, the back-up provides operating current to the drilling system, albeit for a limited duration as compared to the primary supply. But the backup power may also be employed even if the primary power is available, if desired.

These power generation and back-up systems need not be only located on the rig 20. The subsea stack equipment 14 may receive power from their own power supplies. For example, the LMRP control module 50 may be coupled to a subsea power generator 60, and the BOP control module 54 may be coupled to its own power generator 62 or to the LMRP's. These power generators 60, 62 may be similar to those on the rig, including a both a primary supply and a back-up supply or just one of those.

Moving to electrical operation of the subsea stack 14 yields a number of advantages. It eliminates the need for large banks of hydraulic accumulators—and their associated equipment, like hydraulic power units, hoses and hose reels, and piping, to name a few—to be deployed with the subsea stack equipment. This reduces the overall weight, size, and cost of the subsea stack equipment.

Moreover, traditional hydraulic systems do not provide the desired resolution regarding operational conditions. For example, depletion of hydraulic control fluid from the accumulators can be measured, but it may not be sufficiently granular so as to provide the operator with good information regarding the system's true condition. In contrast, electric systems can provide more accurate representations of power levels and battery levels, for example. Another advantage of electrical systems is that they provide more accurate feedback regarding the position of various components. That is, in conventional hydraulic systems, it is difficult to, with a high degree of resolution, determine the amount of movement of a piston driving a BOP ram, that movement being caused by the hydraulic control fluid. However, in an electrically driven system in which movement of the BOP rams is effected by an electric motor, for instance, the location information is more accurate, as fewer environmental factors affect the electrical system as compared to the hydraulic system, reducing the number of variables that must be factored to make an assessment. Ultimately, having better data and operational knowledge of the system can create a feedback loop, where analysis of the data yields more accurate estimates of potential failure points and need for maintenance. The surface and subsea components may include data or event loggers that, using the data network, collect and record data regarding the system. In the event of a malfunction or other incident, these loggers can be used to investigate and assess conditions leading up to the undesired event.

Further still, electrically actuated components can provide actuation much faster than hydraulic control fluid, particularly if there is a large distance between the hydraulic fluid source and the operated function.

But there are embodiments in which some hydraulic fluid may still be employed to operate the subsea equipment stack 14, even though it is predominately electric. For example, in one embodiment, the various functions may be effected by hydraulic control fluid that is pressurized locally by an electrically driven subsea pump, for example, powered by the above-described electrical power supplies. In at least some embodiments, the rig 20 is not connected to the subsea wellhead assembly 14 so as to provide hydraulic control fluid from the rig to the subsea wellhead assembly to enable drilling functions of the subsea wellhead assembly. That is, even if hydraulic control fluid is used by the subsea wellhead assembly 14 to perform a drilling function in some embodiments, that drilling function can be performed with a local, subsea source of hydraulic control fluid rather than with hydraulic control fluid provided from the rig 20 (e.g., via an umbilical) at the time the drilling function is performed.

To operate in harsh environments, like those found when operating subsea, the drilling system has redundancy. The left sides of FIGS. 2A-2D show a "yellow" data and power network, and the right sides have a "blue" system. Each of the "yellow" and "blue" systems is capable of providing data, control, communications and power independent of the other. Thus, if a component on or the entire "yellow" system fails, the operator can immediately maintain control using the "blue" system, or vice versa. The exemplary system 10 is not limited to just two redundancies; any number of additional redundant systems—such as a third or "green" system—can be added to improve the rig's reliability and reduce its nonproductive time.

The exemplary system 10 also has a number of remote-operating vehicle (ROV) ports and access points that facilitate continuous operation of the drilling system. For example, each of the functions of the subsea stack 14 includes one or more ROV access points 63 through which an ROV can effect a function, whether mechanically or electrically. That is, the ROV may be operated to manually open or close valves, or the ROV may provide command signals and power to close the valve, as examples.

The ROV may also couple to subsea power and control components. For example, in the illustrated drilling system, the subsea power generator 62 has an ROV charging port 66 that allows ROV to provide electrical power to the subsea stack equipment 14, whether directly or indirectly, by charging the battery back-up, for instance. Moreover, the system may include an ROV interface port 68 that allows the ROV to communicate with the data network 32 and/or a data storage device located in a subsea electronic module recording the system's data, independent of the command architecture. Thus, if control at the rig 20 is lost, the ROV can fully operate and communicate with the subsea stack equipment 14. And command controls from the ROV can even be communicated to the subsea stack equipment 14 acoustically, with the ROV having a transducer that communicates with the transducer on the subsea stack's acoustic system.

It's also envisaged that the two ROV ports 66, 68 can be integrated into a single port that allows power and data communications over a single connection with the ROV.

Figure 3A:
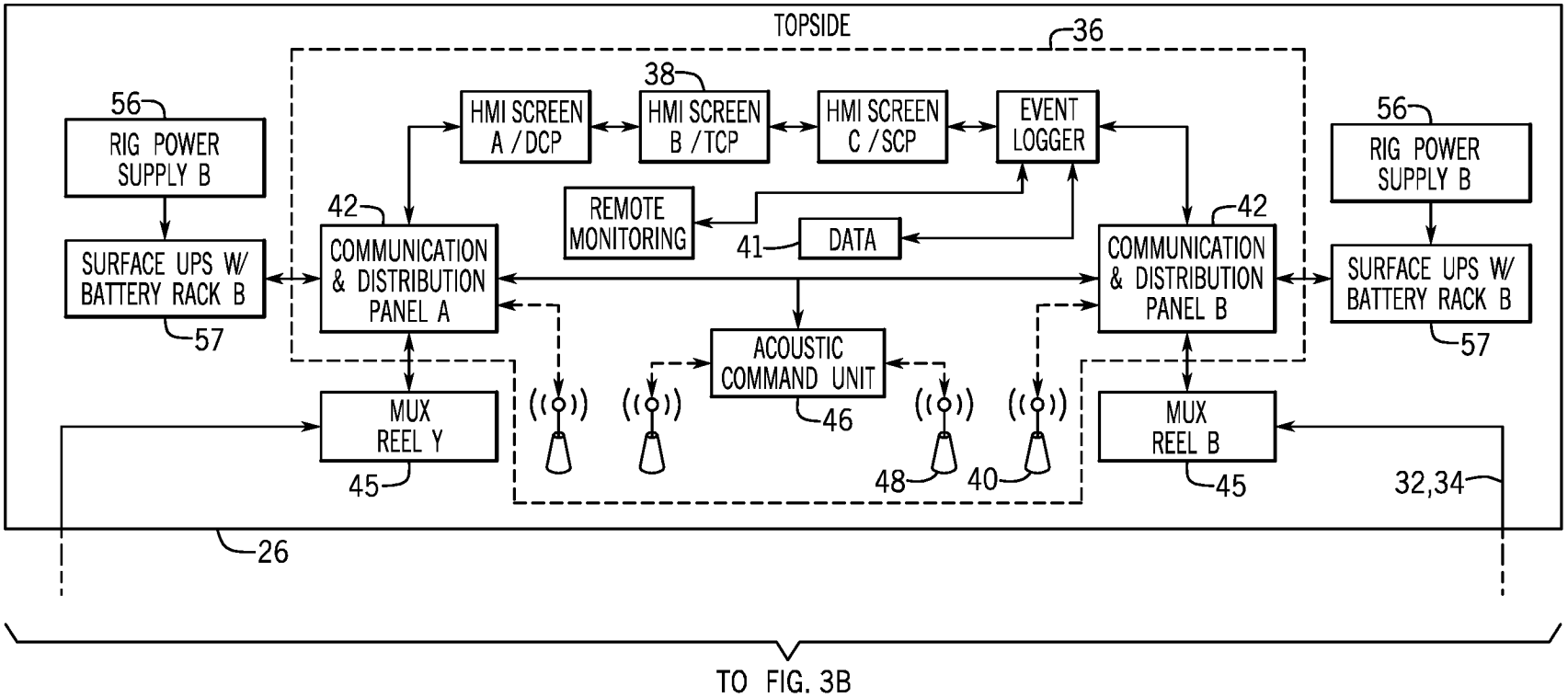
FIGS. 3A-3C illustrate schematically the electrical power and communications topology of a subsea drilling system, in accordance with an embodiment of the present disclosure.
Figure 3B:
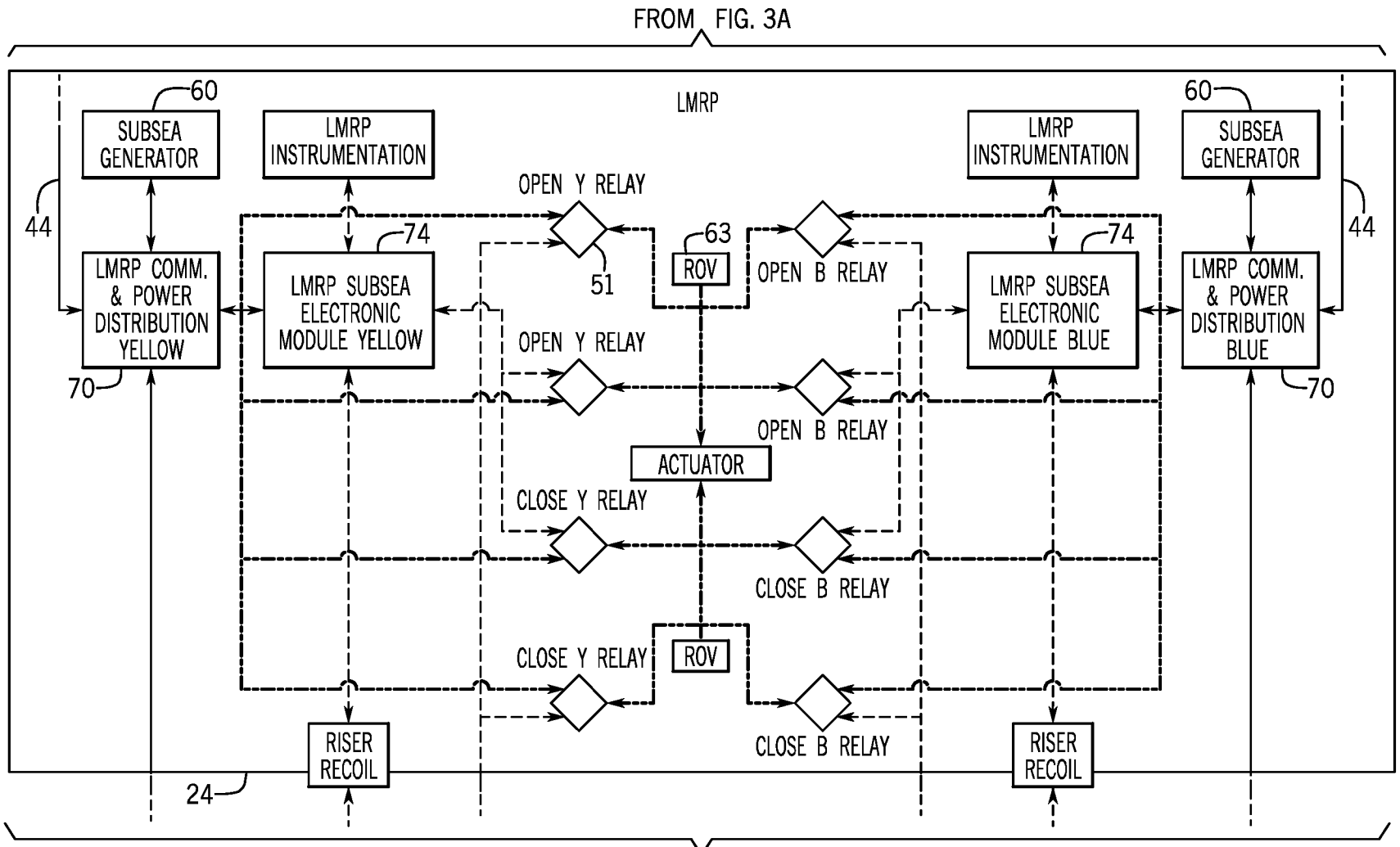
Figure 3C:
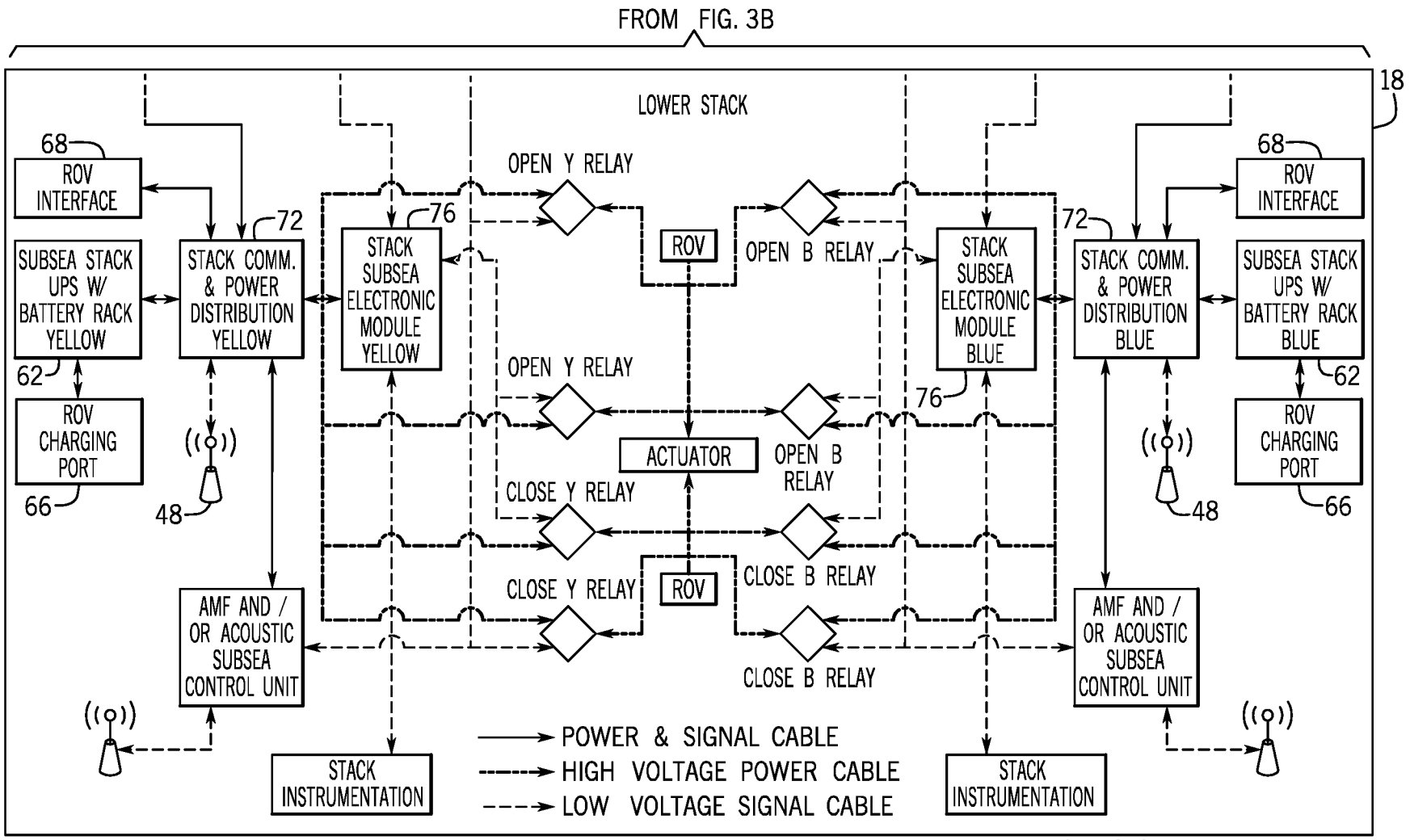
Figure 4A:
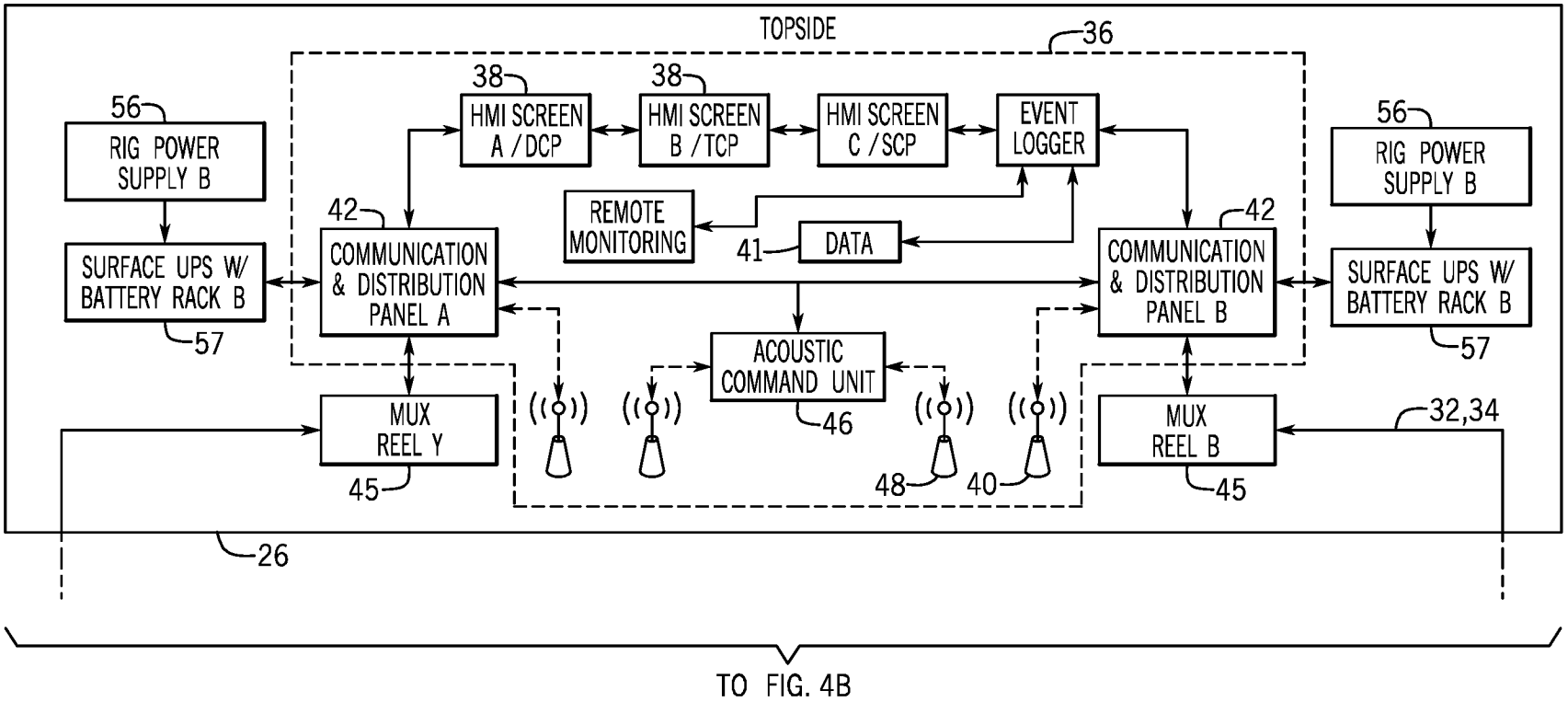
FIGS. 4A-4D illustrate schematically the electrical power and communications topology of a subsea drilling system, in accordance with an embodiment of the present disclosure.
Figure 4B:
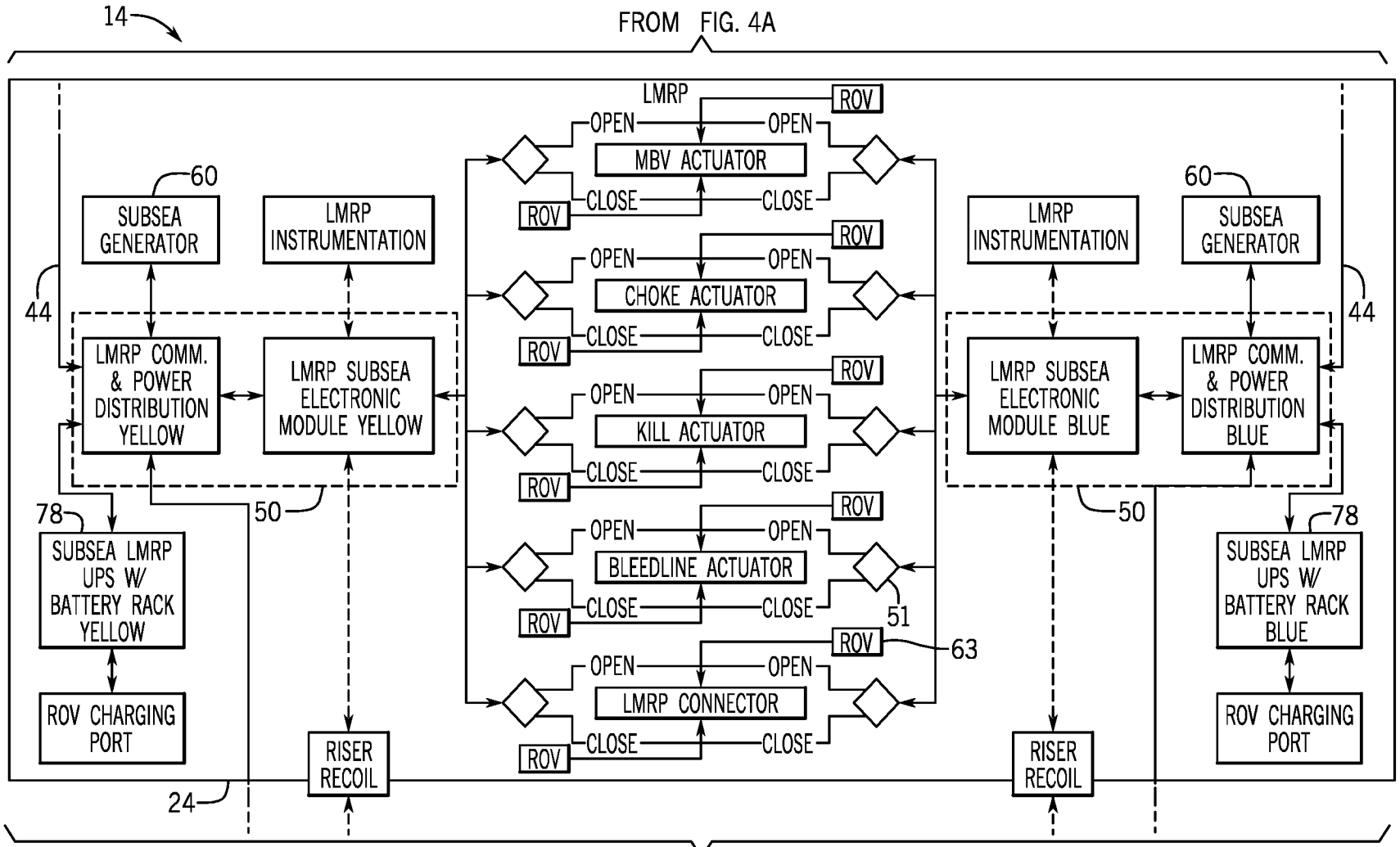
Figure 4C:
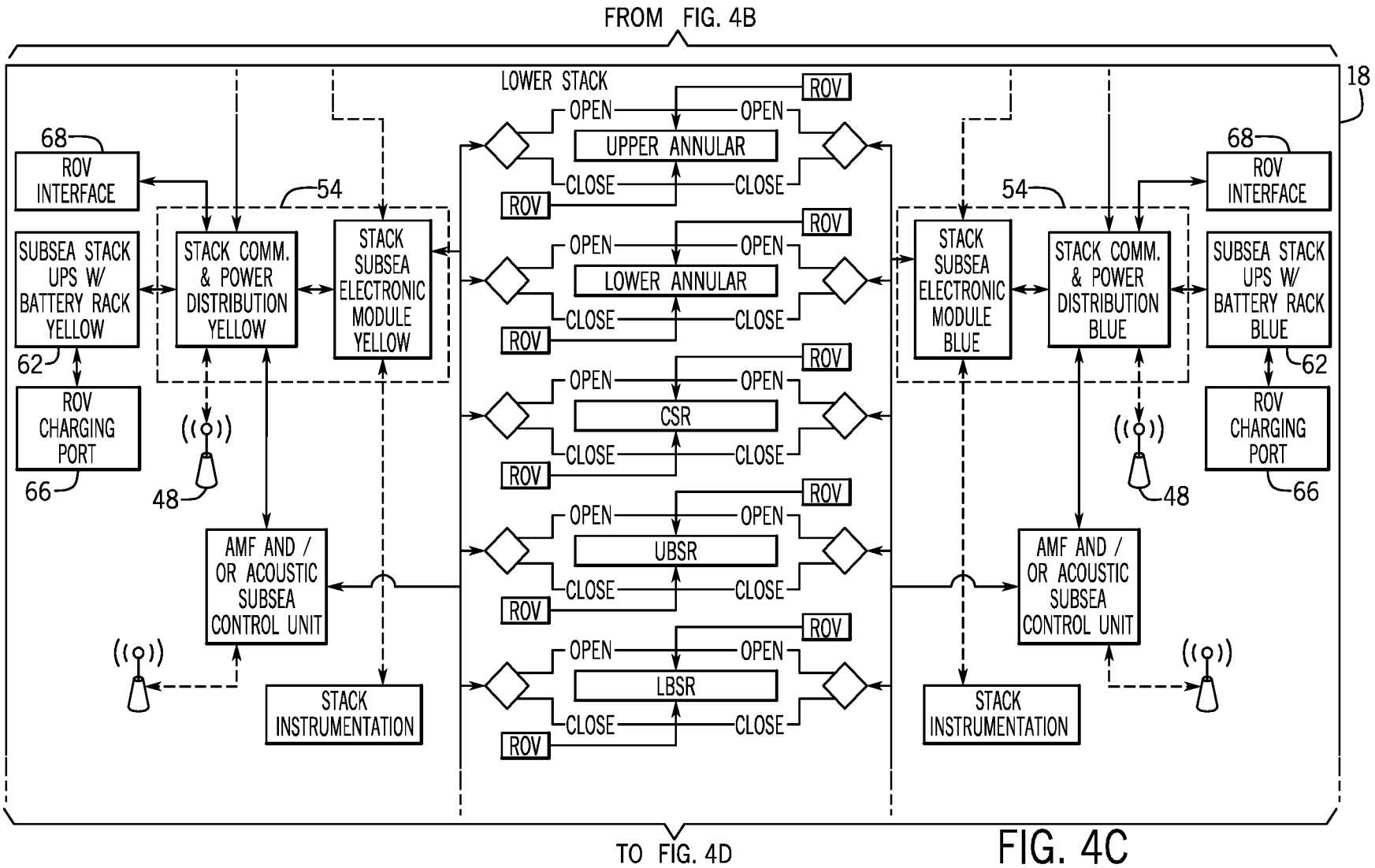
Figure 4D:
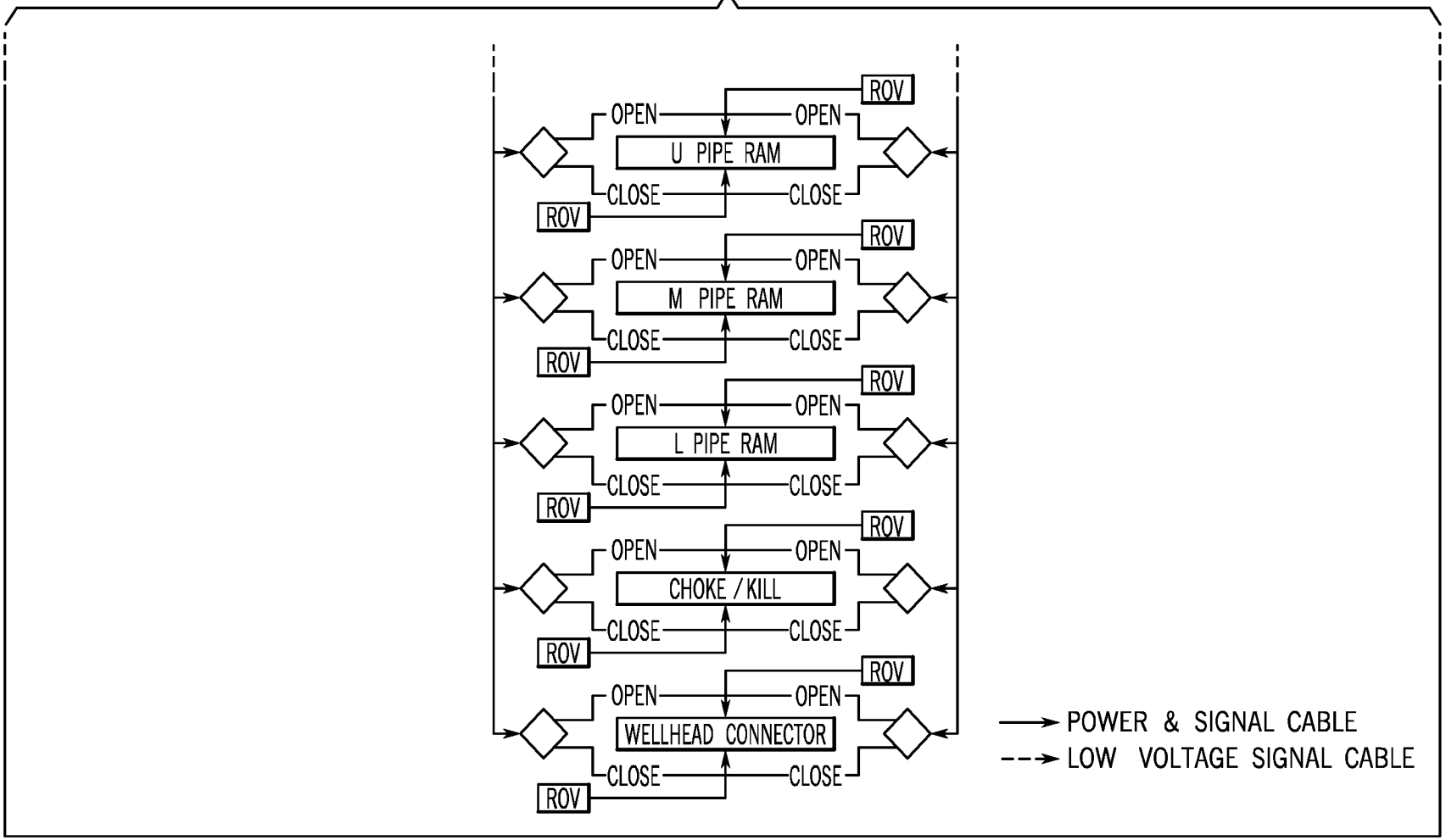
Figure 5A:
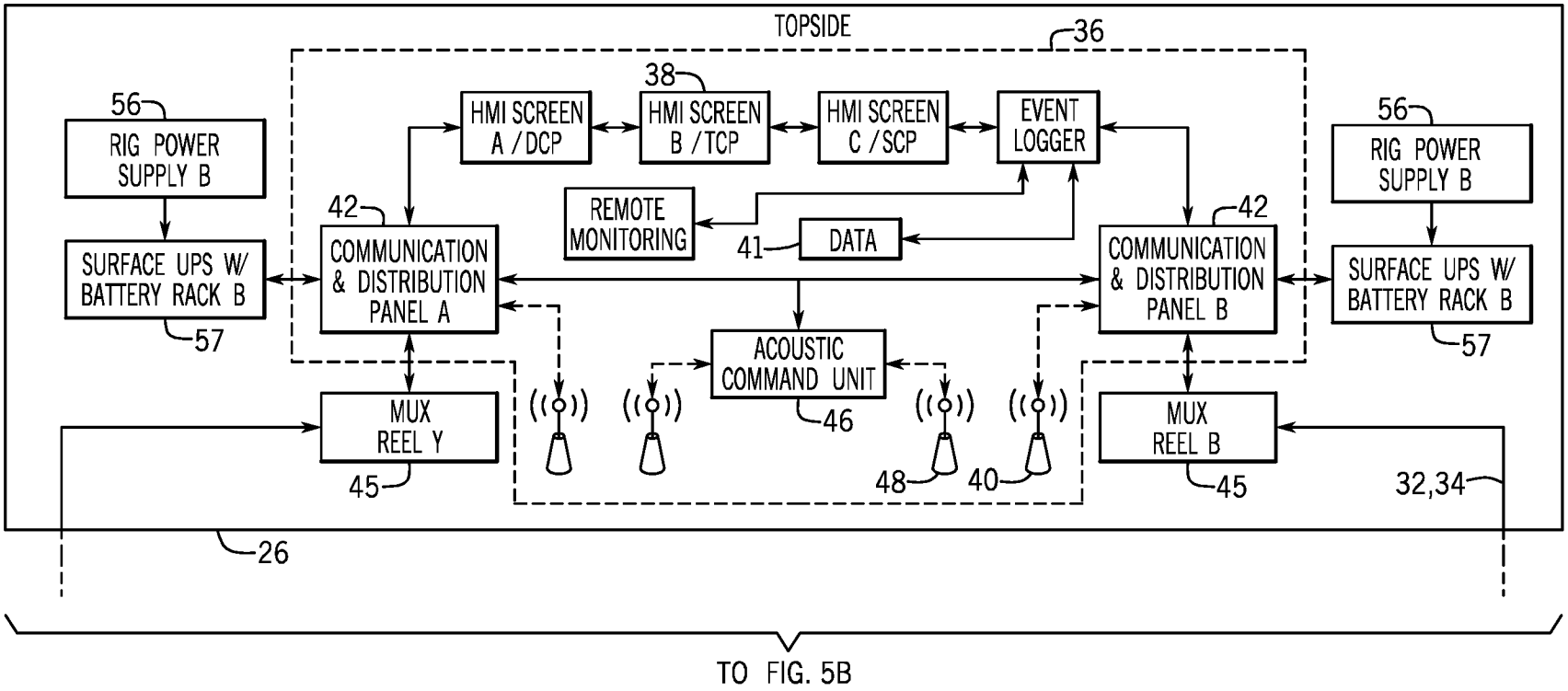
FIGS. 5A-5C illustrate schematically the electrical power and communications topology of a subsea drilling system, in accordance with an embodiment of the present disclosure.
Figure 5B:
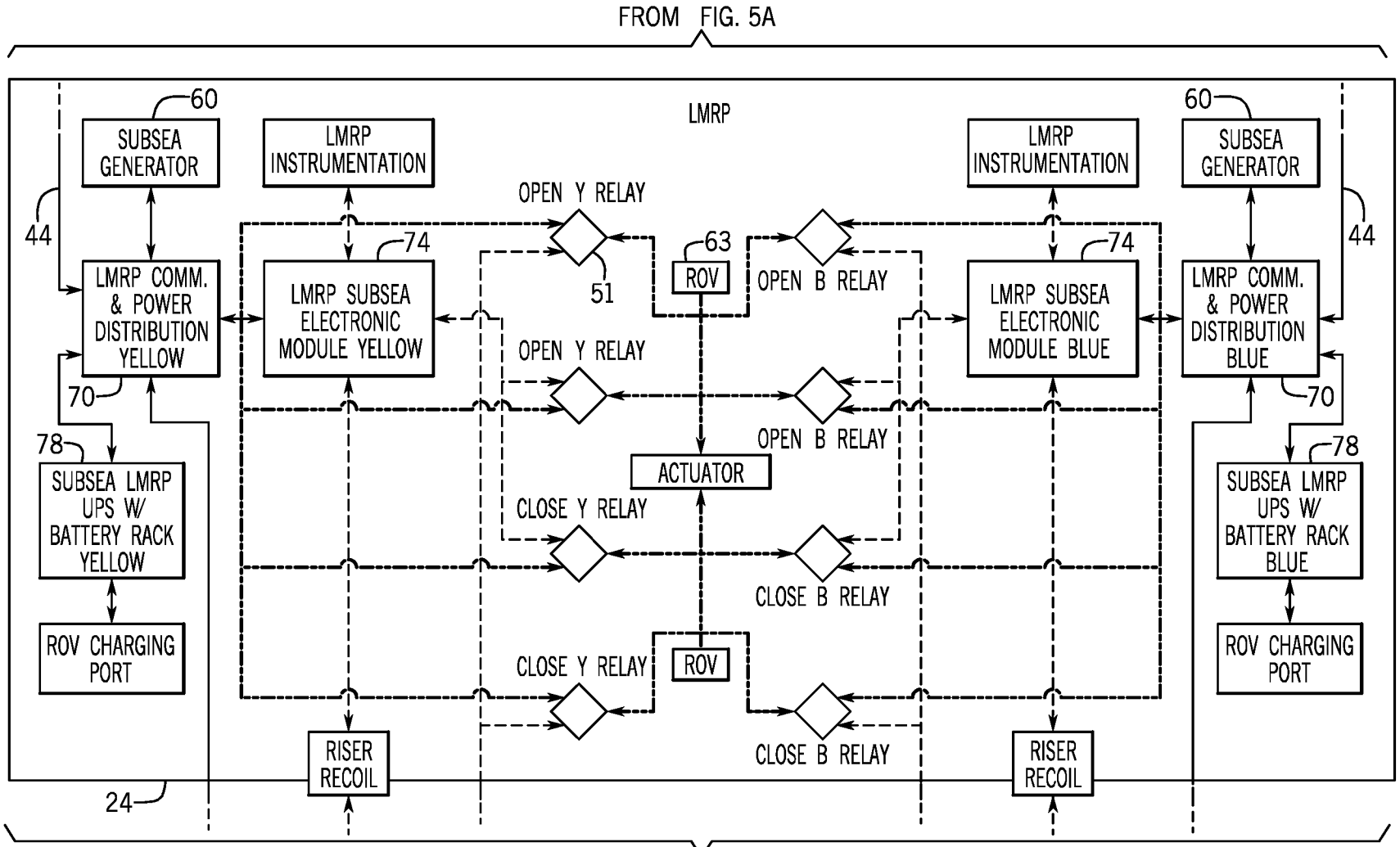
Figure 5C:
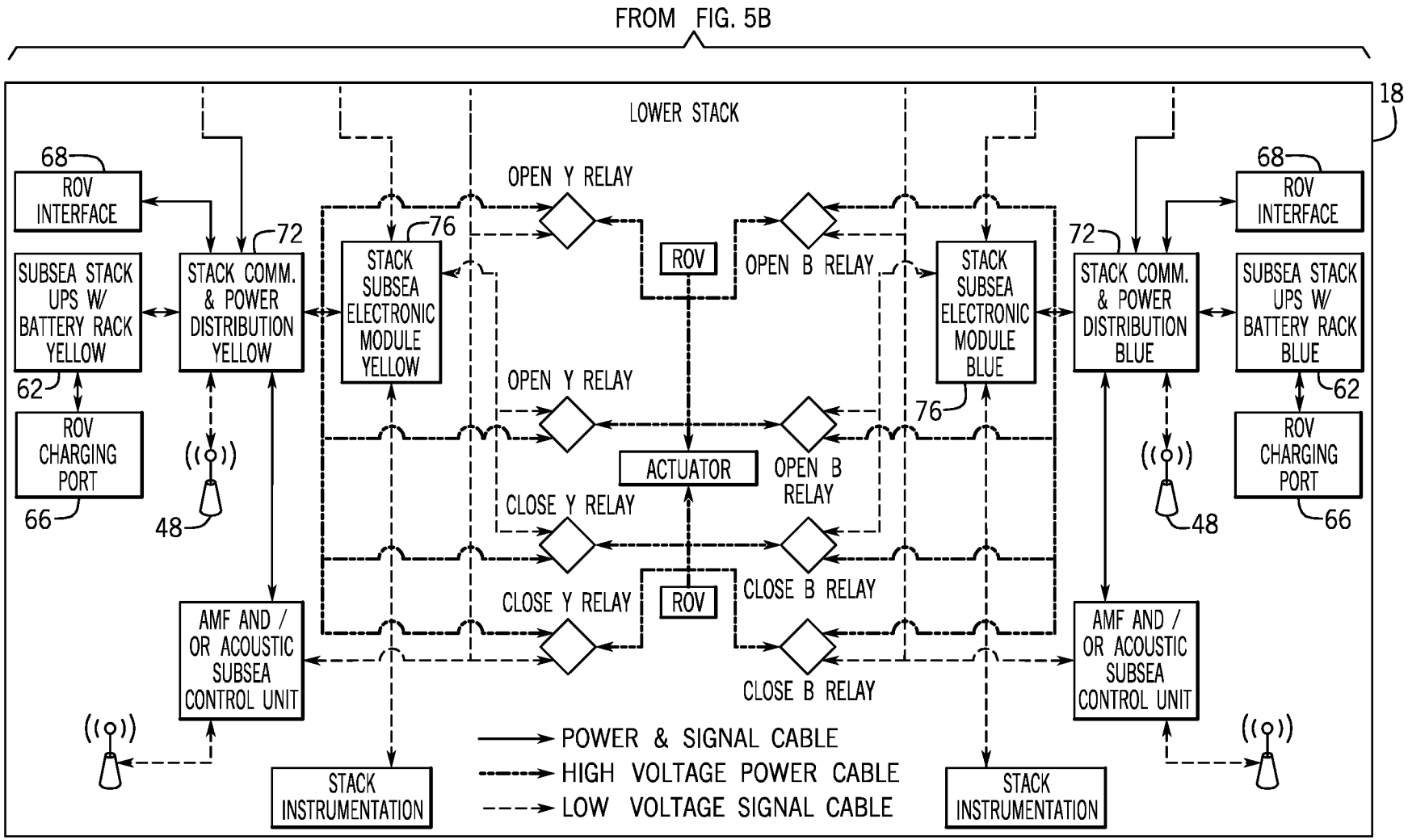

FIGS. 3A-3C illustrate a data and power communications topology for a drilling system 10, in accordance with an embodiment of the invention. In this embodiment, power and data from the rig 20 are transmitted to an LMRP power and communications distribution module 70 and a BOP power and communications distribution module 72. At these modules, high voltage operating power and lower voltage signal power are bifurcated. The lower voltage signal power is communicated to an LMRP and a BOP control module 74 and 76, respectively. These control modules operate relays 51 to control actuators. Although each of FIGS. 3B and 3C depict a single actuator for simplicity, the control modules 74 and 76 can operate numerous drilling functions via multiple actuators, as described above. Upon receiving the appropriate signal, the control module, using lower voltage signal power, trips a relay into either the open or closed state, thus providing or restricting higher voltage operating power to the given function, such a driving an electric actuator to close a shear ram. Moreover, the power and communications distribution modules 70, 72 may route high voltage power to the various back-up power sources within the drilling system. Advantageously, the power and communications distribution modules 70, 72 may include variable-frequency drive (VFD) circuitry that can provide more precise control of the electric motors within the system, for example.

Turning to FIGS. 4A-4D and 5A-5C, these figures illustrate alternate embodiments of the drilling system. In these embodiments, the operating power for the functions can be provided by battery systems 62 and 78. However, these battery systems are charged by the power supply on the rig 20 and/or those power supplies more local to the subsea stack equipment 14. Put differently, the functions on the subsea stack receive current from the batteries, with the batteries being charged by one or mechanisms for charging. And, in situations where repeated operations of the system's functions are not expected, the batteries can be trickle charged, further reducing the number of components on, the weight, and the size of the subsea stack and drilling rig. As with FIGS. 2A-2D and 3A-3C, the actuators and functions represented in FIGS. 4A-4D and 5A-5C are provided as examples, and the control modules of these systems can effect various additional or other drilling functions via actuators in a variety of embodiments.

Figure 6:
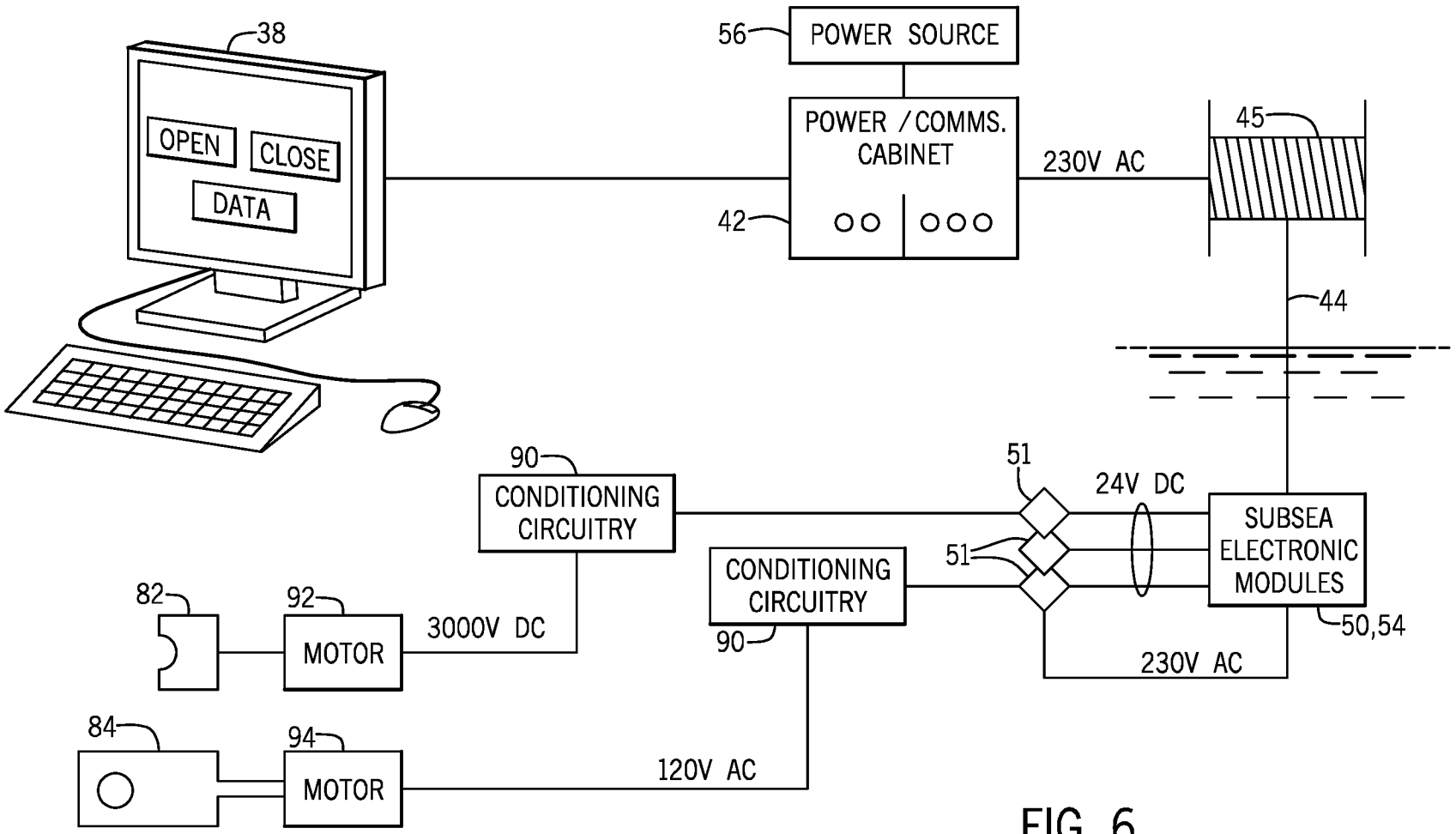
FIG. 6 illustrates schematically the topology and process for activating a function of a subsea drilling system, in accordance with one embodiment of the present disclosure.

Concluding with FIG. 6, it illustrates the operation of certain functions within the drilling system. In this embodiment, an operator, using the HMI interface 38, triggers two functions: the closing of a BOP pipe ram 82 and the opening of a gate valve 84. The commands are sent from the HMI interface, over the data network 32, and to the communication and distribution panel 42. There, a 230V AC power current is overlaid onto the command signal and sent to a MUX cable 44 disposed on a reel 45, which itself may be operated by an electric motor rather than hydraulic or pneumatic systems. Both the power and the command signal are sent down to the subsea stack 14, specifically to the subsea communications and power distribution modules 50, 54. There, the command and power signals are bifurcated, with the command signal—a 24V DC signal—being sent to the relays' gates and the 230V AC current being transmitted through the relay 51. Power exiting the relay 51 is then sent to a conditioning circuit 90, so that the current is appropriate for the given function. For example, the power may be rectified to output 3000V DC to drive a high torque motor 92 for closing a BOP ram. Or the voltage may be transformed down to 120V AC to operate a relatively small gate valve via a motor 94.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A drilling system, comprising:

a rig; and a subsea wellhead assembly configured to perform a plurality of drilling functions, the subsea wellhead assembly comprising a wellhead, a blowout preventer stack, and a lower marine riser package (LMRP), wherein:

the plurality of drilling functions of the subsea wellhead assembly are effected electrically and without supply of hydraulic fluid from the rig;

the blowout preventer stack includes an energy storage device and at least one remote operating vehicle (ROV) charging port coupled to the energy storage device, the ROV charging port being configured to receive power from a ROV to charge the energy storage device for the blowout preventer stack; and at least one drilling function of the plurality of drilling functions is performed using charge from the energy storage device.

2. The drilling system of claim 1, wherein electrical power supplied from the energy storage device is bifurcated at the subsea wellhead assembly to yield bifurcated power, wherein the at least one drilling function is performed using the bifurcated power.

3. The drilling system of claim 1, wherein the rig is not connected to the subsea wellhead assembly so as to supply the hydraulic fluid to the subsea wellhead assembly.

4. The drilling system of claim 1, wherein the at least one drilling function comprises actuating a valve or a connector of the blowout preventer stack of the subsea wellhead assembly.

5. The drilling system of claim 1, further comprising an electrical power supply on the rig configured to provide power to the subsea wellhead assembly via an electrical cable.

6. The drilling system of claim 1, wherein the at least one drilling function comprises actuating a shear ram blowout preventer component to shear a drillpipe.

7. A drilling system, comprising:

a rig; and a subsea wellhead assembly configured to perform multiple drilling functions and comprising a wellhead, a blowout preventer stack, and a lower marine riser package (LMRP), wherein:

the rig is coupled to the subsea wellhead assembly but is not coupled so as to provide hydraulic control fluid from the rig to the subsea wellhead assembly to enable the multiple drilling functions;

the blowout preventer stack includes an energy storage device and at least one remote operating vehicle (ROV) charging port coupled to the energy storage device, the ROV charging port being configured to receive power from a ROV for charging the energy storage device;

electrical power supplied from the energy storage device is converted to a plurality of different voltages by circuitry of the subsea wellhead assembly; and at least one of the multiple drilling functions is performed using at least one of the plurality of different voltages.

8. The drilling system of claim 7, further comprising an electrical power supply on the rig connected to the subsea wellhead assembly via an electrical cable to provide power from the rig to the subsea wellhead assembly.

9. The drilling system of claim 8, wherein the electrical cable also carries data signals between the subsea wellhead assembly and the rig.

10. The drilling system of claim 7, wherein the blowout preventer stack is a lower blowout preventer stack configured to perform a first subset of the multiple drilling functions, and wherein the LMRP is configured to perform a second subset of the multiple drilling functions.

11. The drilling system of claim 10, wherein the lower blowout preventer stack is configured to perform each drilling function of the first subset of the multiple drilling functions without the hydraulic control fluid.

12. The drilling system of claim 10, wherein the LMRP is configured to perform each drilling function of the second subset of the multiple drilling functions without the hydraulic control fluid.

13. The drilling system of claim 7, wherein none of the drilling functions performed by the subsea wellhead assembly are effected with the hydraulic control fluid.

14. A method of operating a subsea wellhead assembly, the method comprising:

receiving, at a controller of the subsea wellhead assembly, one or more command signals from a rig, the subsea wellhead assembly comprising a wellhead, a blowout preventer stack, and a lower marine riser package (LMRP);

effecting, via the controller, drilling functions of the subsea wellhead assembly, wherein the subsea wellhead assembly is an all-electric subsea wellhead assembly configured to operate without hydraulic control fluid, and wherein effecting the drilling functions of the subsea wellhead assembly includes electrically effecting, via an energy storage device at the blowout preventer stack, the drilling functions without use of the hydraulic control fluid from the rig; and receiving, via at least one remote operating vehicle (ROV) charging port at the subsea wellhead assembly, power from a ROV for charging the energy storage device.

15. The method of claim 14, further comprising supplying electrical power from a power supply on the rig to the subsea wellhead assembly via an electrical cable.

16. The method of claim 14, further comprising bifurcating, at the subsea wellhead assembly, electrical power supplied from the energy storage device to yield bifurcated power, wherein at least one of the drilling functions is performed using the bifurcated power.

17. The method of claim 14, wherein the blowout preventer stack includes a lower blowout preventer stack having the controller.

18. The method of claim 14, wherein electrically effecting the drilling functions without use of the hydraulic control fluid includes issuing control signals from the controller to switching circuitry to direct power from the energy storage device to electric actuators of the subsea wellhead assembly to effect the drilling functions.

19. The method of claim 14, wherein the one or more command signals are received at the LMRP.

20. The method of claim 14, wherein receiving the one or more command signals includes wirelessly receiving the one or more command signals from the rig.

* * * * *